United States Patent [19]

Takahashi

[11] Patent Number: 4,489,486

[45] Date of Patent: Dec. 25, 1984

[54] TOOL FOR ATTACHING A COUPLING ELEMENT TO A CONCEALED SLIDE FASTENER

[75] Inventor: Kihei Takahashi, Uozu, Japan

[73] Assignee: Yoshida Kogyo K. K., Tokyo, Japan

[21] Appl. No.: 491,459

[22] Filed: May 4, 1983

[30] Foreign Application Priority Data

May 4, 1982 [JP] Japan ..... 57-65380[U]

[51] Int. Cl.[3] ..... A41H 37/06; B21D 53/52; B22D 19/10

[52] U.S. Cl. ..... 29/769; 29/410; 29/402.08

[58] Field of Search ..... 29/33.2, 408, 410, 766, 29/769, 402.01, 402.08

[56] References Cited

U.S. PATENT DOCUMENTS 3,259,476 7/1966 Hair ..... 29/410
3,548,483 12/1970 Graf et al. ..... 29/410

FOREIGN PATENT DOCUMENTS 48-40087 11/1973 Japan .

*Primary Examiner*—Howard N. Goldberg
*Assistant Examiner*—Steven E. Nichols
*Attorney, Agent, or Firm*—Hill, Van Santen, Steadman & Simpson

[57] ABSTRACT

A manually operative tool for attaching a coupling element to a concealed slide fastener lacking of one or more coupling elements and hence to be repaired. The tool includes a pair of relatively pivotable first and second members, each having at one end a handle. A lower jaw is secured to the other end of the first member and has at least two first recesses laterally spaced apart from one another by a predetermined distance equal to the element-to-element pitch of a concealed slide fastener to be repaired, each first recess being receptive of a prospective coupling element. An upper jaw is pivotally connected to the other end of the second member and has at its free end a second recess. The upper jaw is movable, in response to relative pivotal movement of the first and second members by manipulating their handles, between a retracted position in which both the prospective coupling element and the fastener stringer are allowed to be placed on the lower jaw, and an advanced position in which the second recess is engageable with a leg portion of the prospective coupling element to deform the leg portion so as to clench the coupling element about a longitudinal tape edge of the fastener stringer.

4 Claims, 2 Drawing Figures

TOOL FOR ATTACHING A COUPLING ELEMENT TO A CONCEALED SLIDE FASTENER

BACKGROUND OF THE INVENTION

1. Field of the Invention

The present invention relates to slide fasteners, and more particularly to a hand tool for attaching a coupling element to a stringer tape of a concealed slide fastener.

2. Prior Art

In the manufacture of concealed slide fasteners, there have been proposed various apparatus for attaching metallic coupling elements to a stringer tape along a longitudinal edge thereof. However, any of these proposed apparatus is automatic; that is, a row of discrete coupling elements is successively clenched about and along the longitudinal tape edge. With such automatic apparatus it is very difficult or virtually impossible to attach a single or a small number of coupling elements to a fastener stringer at a portion where one or more coupling elements are lacking. Japanese Utility Model Publication (Kokoku) No. 48-40087 is believed to exemplify the prior art.

SUMMARY OF THE INVENTION

According to the present invention, a coupling-element attaching tool includes a pair of relatively pivotable first and second members, each having at one end a handle. A lower jaw is removably secured to the other end of the first member and has at least two first recesses laterally spaced apart from one another by a predetermined distance equal to the element-to-element pitch of a concealed slide fastener to be repaired, each first recess being receptive of a prospective coupling element. An upper jaw is removably and pivotally connected to the other end of the second member and has a second recess. In response to relative pivotal movement of the first and second members by manipulating their handles, the upper jaw is movable between a retracted position in which both the prospective coupling element and the stringer tape are allowed to be placed on the lower jaw, and an advanced position in which the second recess is engageable with a leg portion of the coupling element to deform the leg portion so as to clench the coupling element about a longitudinal edge of the stringer tape. Movement of the upper jaw between its advanced and retracted positions is regulated by a guide pin mounted on the first member and slidable, in response to relative pivotal movement of the first and second members, on and along a cam surface provided on the upper jaw.

It is therefore an object of the invention to provide a hand tool for attaching only a single or a small member of coupling elements to a fastener stringer of a concealed slide fastener lacking of one or more coupling elements and to be repaired.

Another object of the invention is to provide a manually operative, coupling-element attaching tool in which a pair of upper and lower jaws can be replaced with those having recesses of a different size in order to meet the size and pitch of the coupling elements of a concealed slide fastener to be repaired.

Still another object of the invention is to provide a manually operative coupling element attaching tool by which one or more coupling elements can be attached to a fastener stringer at uniform intervals of a predetermined distance equal to the element-to-element pitch of a concealed slide fastener to be repaired.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
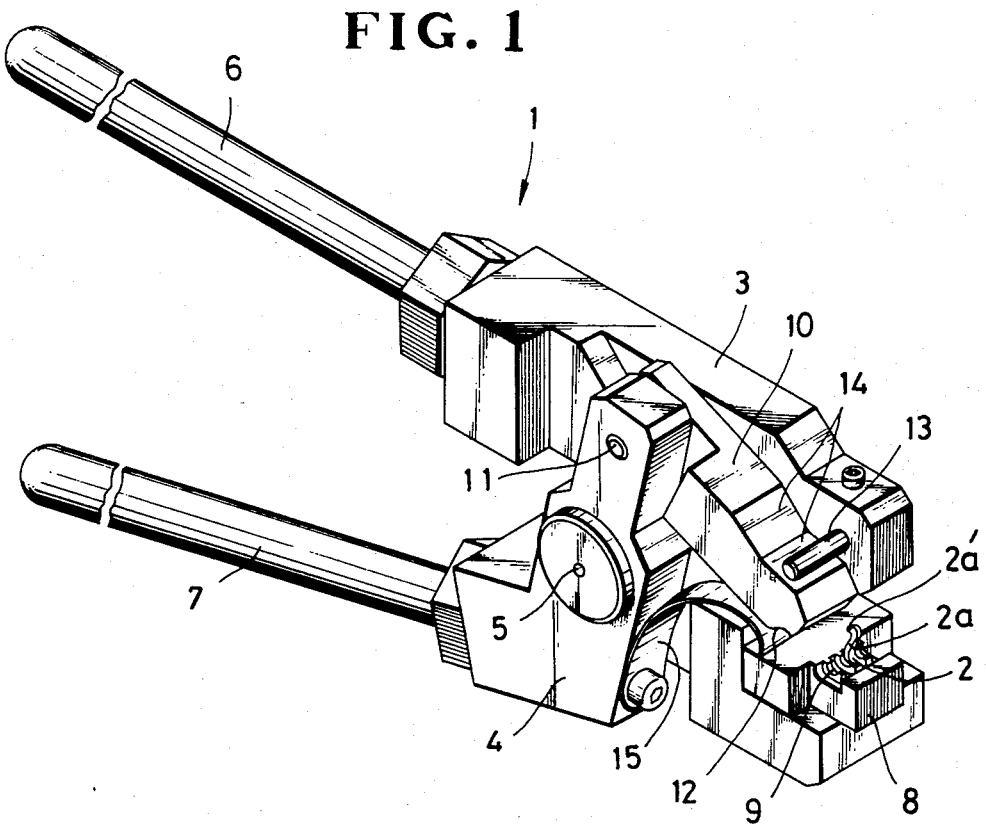
FIG. 1 is a perspective view of a coupling-element attaching tool embodying the present invention.

FIG. 1 shows a manually operative, coupling-element attaching tool 1 which is particularly useful when a fastener stringer of a concealed slide fastener (now shown) is lacking of one or more coupling elements and is hence to be repaired. The fastener stringer has a row of discrete metallic coupling elements mounted on a stringer tape along an inner longitudinal edge thereof.

The tool 1 includes a pair of first and second members 3, 4 pivotally connected to one another by an axle 5, each member 3, 4 having at one or rear end a handle 6, 7. The first and second members 3, 4 are pivotally movable by manipulating their handles 6, 7.

A lower jaw 8 is removably (for a purpose described below) secured to the other or front end of the first member 3. The lower jaw 8 has at least two upwardly opening first recesses 9 laterally spaced apart from one another by a predetermined distance equal to the element-to-element pitch of a concealed slide fastener (not shown) to be repaired, each first recess 9 being receptive of a prospective coupling element 2. The coupling element 2 for a concealed slide fastener has a leg *2a* portion terminating in an outwardly bent end *2a'*.

An upper jaw 10 is removably (for a purpose described below) and pivotally connected at one or rear end to the other or front end of the second member 4 by a pin 11 and has at the other or front end a downwardly opening second recess 12. In response to relative pivotal movement of the first and second members 3, 4 by manipulating their handles 6, 7, the upper jaw 10 is movable between a retracted position (FIG. 1) and an advanced position (not shown). With the upper jaw 10 in its retracted position, both the prospective coupling element 2 and the non-illustrated fastener stringer are allowed to be placed on the lower jaw 8, at which time the coupling element 2 is received in one of the first recesses 9 with its leg portion *2a* directed substantially upwardly as shown in FIG. 1.

At the end of the upper jaw's forward stroke, i.e. when the upper jaw 10 is in its advanced position, the second recess 12 is engageable with the leg portion *2a* of the prospective coupling element 2 to deform the leg portion *2a* so as to clench the coupling element 2 about the inner longitudinal edge of the non-illustrated stringer tape.

This movement of the upper jaw 10 between its advanced and retracted positions is regulated by a guide pin 13 mounted on the front end of the first member 3 and slidable, in response to relative movement of the first and second members 3, 4, on and along a cam surface 14 provided on the upper jaw 10. A leaf spring 15 is mounted between the upper jaw 10 and the second member 4 to normally urge the upper jaw 10 at the cam surface 14 against the guide pin 13.

Figure 2:
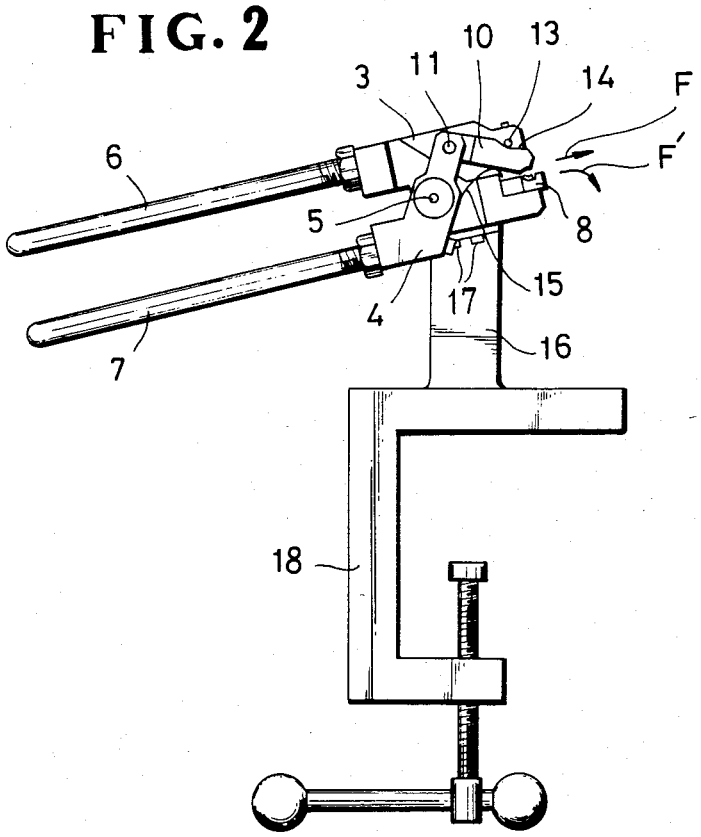
FIG. 2 is a side elevational view, on a reduced scale, of the attaching tool of FIG. 1, showing the tool having been mounted on a support.

In use, as shown in FIG. 2, it is preferable to secure the first member 3, by a pair of screws 17, 17, to a support 16 upwardly projecting from a base 18 adapted to be fixed to a work table (not shown). With the upper jaw 10 in its retracted position (FIG. 1), a metallic coupling element 2 to be attached is placed in one of the first recesses 9 of the lower jaw, and then a fastener stringer (not shown) to be repaired is placed thereon.

Then, when the two handles 6, 7 are moved by hand toward one another, the second member 4 is pivotally moved in a clockwise direction with respect to the first member 3, causing the upper jaw 10 to be moved to its advanced position. During that time, because of the guide pin 13 and the cam surface 14, the upper jaw 10 is moved first in the direction of a straight arrow F and then in the direction of an arcuate arrow F'. At the end of the upper jaw's forward stroke, the second recess 12 engages the leg portion 2*a* of the prospective coupling element 2 to deform the leg portion 2*a* so as to clench the coupling element 2 about the inner longitudinal edge of the non-illustrated stringer tape.

With the coupling-element attaching tool 1 it is possible to attach only a single or a small number of coupling elements 2 to a fastener stringer of a concealed slide fastener which is lacking one or more coupling elements and hence is to be repaired. Further, since the first recesses 9 are spaced apart from one another by a predetermined distance equal to the element-to-element pitch of the concealed slide fastener to be repaired, accurate attachment of the coupling elements 2 can be achieved.

Another advantage of the tool 1 is that the upper and lower jaws 8, 10 can be easily replaced with those having first and second recesses of a different size in order to meet the size and pitch of the coupling elements of the concealed slide fastener to be repaired.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A hand tool for attaching a metallic coupling element to a stringer tape of a concealed slide fastener, comprising:

(a) a pair of first and second members pivotally connected to one another, each member having at one end a handle;

(b) a lower jaw secured to the other end of said first member on an inner side thereof and having at least two first recesses laterally spaced apart from one another by a predetermined distance, each of said first recesses being receptive of a prospective coupling element;

(c) an upper jaw pivotally connected at one end to the other end of said second member and having at the other end a second recess engageable with a leg portion of the coupling element placed in one of said first recesses, said upper jaw being movable, in response to pivotal movement of said first and second members relatively to one another by manipulating such two handles, between a retracted position in which said second recess is disposed remotely from said first recess for allowing both the prospective coupling element and the stringer tape to be placed on said first jaw, and an advanced position in which said second recess is disposed close to said first recesses for deforming the leg portion of the coupling element so as to clench the latter about a longitudinal edge of the stringer tape; and (d) means for regulating movement of said upper jaw with respect to said lower jaw while said upper jaw is moved between said retracted and advanced positions.

2. A tool according to claim 1, said regulating means comprising a cam surface disposed on an upper side of said upper jaw, and a guide pin extending inwardly from the other end of said first member and slidable, in response to relative movement of said first and second member on and along said cam surface.

3. A tool according to claim 2, said regulating means further including a spring acting between said second member and said upper jaw to normally urge the latter against said guide pin.

4. A tool according to claim 1, said upper and lower jaws being removably connected to said second and first members, respectively.

* * * * *